US005164975A

United States Patent [19]

Steinmeyer

[11] Patent Number: 5,164,975

[45] Date of Patent: Nov. 17, 1992

[54] MULTIPLE WAVELENGTH X-RAY MONOCHROMATORS

[75] Inventor: Peter A. Steinmeyer, Arvada, Colo.

[73] Assignee: The United States of America as represented by the United States Department of Energy, Washington, D.C.

[21] Appl. No.: 714,805

[22] Filed: Jun. 13, 1991

[51] Int. Cl.[5] ..... G21K 1/06

[52] U.S. Cl. ..... 378/85; 378/84; 378/145

[58] Field of Search ..... 378/82, 84, 85, 81, 378/145

[56] References Cited

U.S. PATENT DOCUMENTS

| | | | |
|---|---|---|---|
| 3,772,522 | 11/1973 | Hammond et al. | 250/503 |
| 4,084,089 | 4/1978 | Zingaro et al. | 250/272 |
| 4,322,618 | 3/1982 | Jenkins | 250/272 |
| 4,649,557 | 3/1987 | Hornstra et al. | 378/84 |
| 4,675,889 | 6/1987 | Wood et al. | 378/84 |
| 4,693,933 | 9/1987 | Keem et al. | 428/333 |
| 4,737,973 | 4/1988 | Ogawa et al. | 378/84 |
| 4,788,703 | 11/1988 | Murakami et al. | 378/85 |
| 4,796,284 | 1/1989 | Jenkins | 378/85 |
| 4,958,363 | 9/1990 | Nelson et al. | 378/85 |

*Primary Examiner*—David P. Porta
*Attorney, Agent, or Firm*—Anne D. Daniel; James H. Chafin; William R. Moser

[57] ABSTRACT

An improved apparatus and method is provided for separating input x-ray radiation containing first and second x-ray wavelengths into spatially separate first and second output radiation which contain the first and second x-ray wavelengths, respectively. The apparatus includes a crystalline diffractor which includes a first set of parallel crystal planes, where each of the planes is spaced a predetermined first distance from one another. The crystalline diffractor also includes a second set of parallel crystal planes inclined at an angle with respect to the first set of crystal planes where each of the planes of the second set of parallel crystal planes is spaced a predetermined second distance from one another. In one embodiment, the crystalline diffractor is comprised of a single crystal. In a second embodiment, the crystalline diffractor is comprised of a stack of two crystals. In a third embodiment, the crystalline diffractor includes a single crystal that is bent for focussing the separate first and second output x-ray radiation wavelengths into separate focal points.

17 Claims, 3 Drawing Sheets

MULTIPLE WAVELENGTH X-RAY MONOCHROMATORS

The U.S. Government has rights in this invention pursuant to Contract No. DE-AC04-76DP03533 between the United States Department of Energy and Rockwell International (Now known as EG&G Rocky Flats, Inc.).

BACKGROUND OF THE INVENTION

The present invention relates to the field of crystal monochromators, and more particularly to crystal monochromators for providing a monochromatic x-ray wavelength.

In the art of monochromators, a number of techniques are known to provide a monochromatic wavelength.

In U.S. Pat. No. 3,772,522, a crystal monochromator for x-rays is disclosed which employs a spherically bendable quartz disc rigidly attached to a spherically shaped rigid quartz substrate to form a diffraction element. The x-ray source, the diffraction element, and a single target are arrayed on a circular array known as a Rowland circle. With this device, plural monochromatic x-ray beams are not provided, and the rigid diffraction element is not capable of being bent in order to focus the x-ray beam on the target.

In U.S. Pat. No. 4,737,973, in the discussion of the background of the invention, there is a disclosure that silicon or germanium crystal material can be sliced to a thickness of several millimeters or less, and stress is applied from the two ends of the slice to focus a single diffracted x-ray beam. There is no disclosure of providing plural monochromatic x-ray beams with the bent crystals that are disclosed. The patented device itself is for a crystal monochromator having a base crystal layer and a plurality of crystal layers stacked on the base crystal layer, where the upper crystal layer of the stack has a larger spacing of lattice plane than that of each lower crystal layer of the crystal stack. This complex device is for focussing a divergent source beam onto a single focal point. This device is not disclosed for providing plural monochromatic beams.

In U.S. Pat. No. 4,675,889, a disclosure is made of a multiple wavelength x-ray dispersive device that can receive an x-ray beam containing a plurality of x-ray wavelengths and provide a plurality of separated x-ray wavelengths at the same or different angles. The dispersive device is comprised of a plurality of vertically stacked layer sets of two parallel layers each. The layers are parallel to the top layer of the vertical stack. The first layer in each set has a first interplanar spacing which provides x-ray diffraction properties at a first wavelength. The second layer in each layer set has a parallel second, and larger, interplanar spacing which provides x-ray diffraction properties at a second wavelength. A large number (20–100) of alternating first sets and second sets are provided. In view of the above, it would be desirable to provide a simple, multiple wavelength x-ray dispersive device that does not require a large number of repeating layered units.

U.S. Pat. No. 4,675,899 also discloses that commercial x-ray dispersive structures are formed from crystalline structures such as LiF, metal acid phthalates (map), pyrolytic graphite, and Langmuir-Blodgett (LB) films. However, there does not appear to be a utilization of crystalline properties of the layered material. For example, nothing in this patent discloses a first set of crystal planes parallel to the top surface along with a second set of crystal planes inclined at an angle of inclination with respect to the top surface.

U.S. Pat. No. 4,649,557 discloses an x-ray analysis apparatus which includes a doubly curved monochromator crystal having doubly curved crystal lattice surfaces, so that the monochromator crystal exhibits mutually and significantly different amounts of surface curvature in different principal directions. With this device, plural monochromatic x-ray beams are not provided.

SUMMARY OF THE INVENTION

Accordingly, it is an object of the present invention to provide plural, separated monochromatic electromagnetic wavelengths from a beam containing a combination of plural electromagnetic wavelengths.

Another object of the present invention is to provide plural, separated monochromatic x-ray wavelengths from an x-ray beam containing a combination of plural x-ray wavelengths.

Another object of the invention is to provide a multiple wavelength x-ray dispersive device that is simple in construction and does not require a large number of repeating layer units.

Another object is to utilize crystalline properties of the x-ray dispersive elements in a crystalline monochromator. More specifically, it an object of the present invention to provide a crystalline monochromator that has a first set of crystal planes parallel to the top surface in conjunction with a second set of crystal planes inclined at an angle of inclination with respect to the top surface.

Additional objects, advantages, and novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved apparatus and method is provided for separating an input ray of radiation, which contains a combination of first and second wavelengths, into spatially separate first and second output rays of radiation which contain the first and second wavelengths, respectively. The apparatus of the invention includes a crystalline diffractor which includes a first set of parallel crystal planes, where each of the planes is spaced a predetermined first distance from one another. And the crystalline diffractor includes a second set of parallel crystal planes inclined at an angle with respect to the first set of crystal planes where each of the planes of the second set of parallel crystal planes is spaced a predetermined second distance from one another.

The apparatus of the invention can be used to separate two desired wavelengths that are present in a background of white radiation.

In accordance with one aspect of the invention, the crystalline diffractor is comprised of a single crystal which includes (a) a first set of parallel crystal planes spaced a predetermined first distance from one another and parallel to the top surface, and (b) a second set of parallel crystal planes inclined at an angle of inclination with respect to the top surface and spaced a predetermined second distance from one another.

In accordance with another aspect of the invention, the crystalline diffractor is comprised of a stack of two crystals, a top crystal and a bottom crystal, wherein one of the two crystals includes a first set of parallel crystal planes spaced a predetermined first distance from one another and parallel to the top surface. The other of the two crystals includes a second set of parallel crystal planes inclined at an angle of inclination with respect to the top surface and spaced a predetermined second distance from one another.

In accordance with yet another aspect of the invention, the crystalline diffractor is comprised of a single crystal that is bent for focussing the separate first and second output radiation rays into separate focal points.

Preferably, the apparatus of the invention is used to provide separated x-ray rays.

With the invention, the crystal interplanar spacings and the orientation of the planes with the crystal surface are properly selected in accordance with the two wavelengths that are present in the combined wavelength beam and that are to be separated into separate beams of different wavelengths.

The crystalline monochromator apparatus of the invention can be used in x-ray spectroscopy, in electron microbeam x-ray spectroscopy, and in other application requiring monochromatic x-ray radiation. Other areas of application include x-ray diffraction such as stress measurement, lattice parameter determination, and powder diffractometry.

Furthermore, multiple wavelength monochromators of the invention can be used to diffract and separate combined gamma rays, combined neutrons, and combined gamma rays and neutrons.

Still other objects of the present invention will become readily apparent to those skilled in this art from the following description, wherein there are shown and described a number of preferred embodiments of this invention. Simply by way of illustration, the invention will be set forth in part in the description that follows and in part will become apparent to those skilled in the art upon examination of the following or may be learned with the practice of the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION

Figure 1:
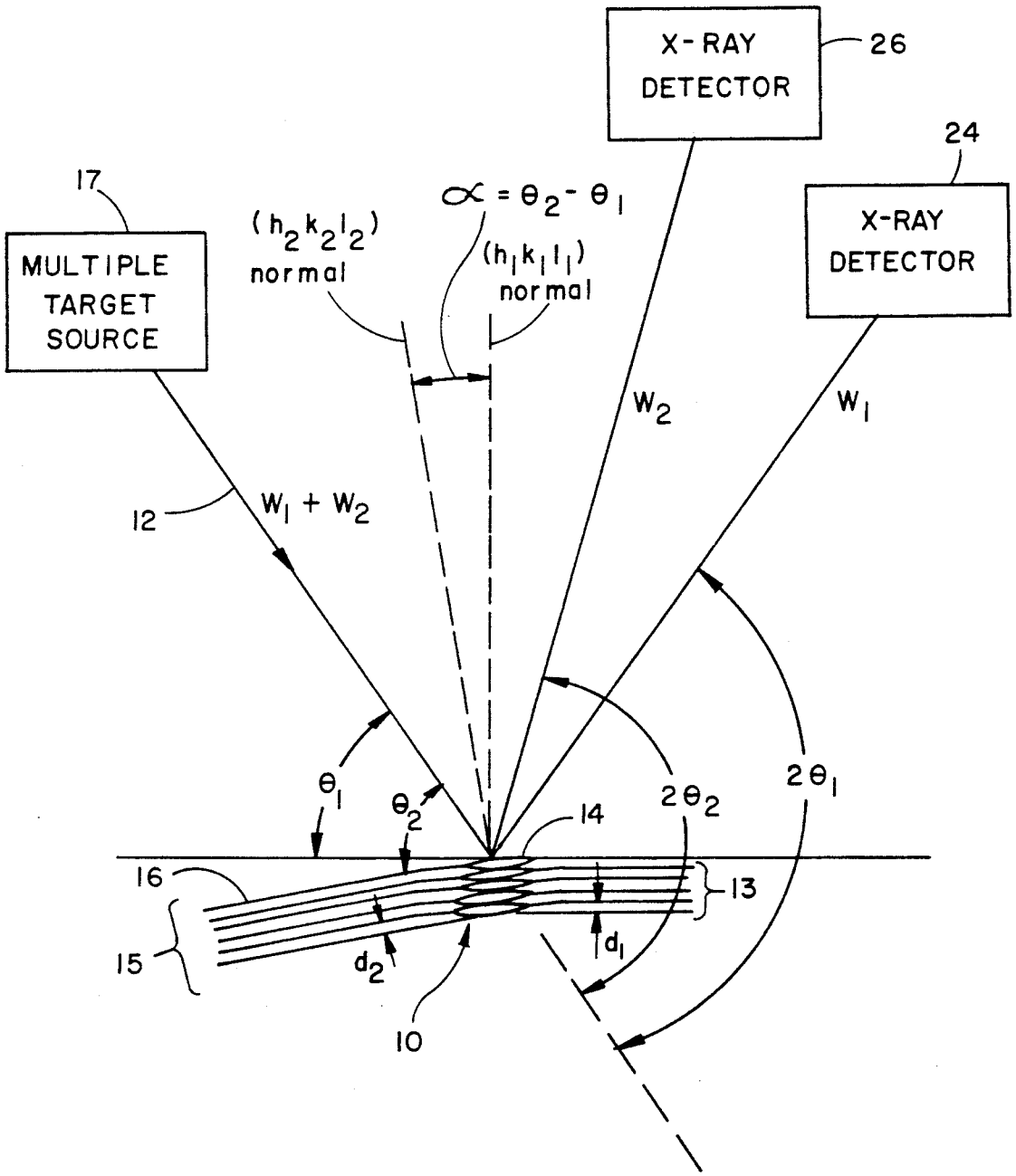
FIG. 1 is a schematic diagram showing an embodiment of the invention in which two wavelengths are separated by a single crystal having flat planar lattice planes.

With reference to the drawings, and more particularly to FIG. 1, an embodiment of the invention is disclosed in which a crystalline diffractor is a single crystal 10. The crystal 10 includes set of lattice planes ($h_1k_1l_1$) (reference number 13) parallel to the top crystal surface 14. The crystal 10 also includes another set of lattice planes ($h_2k_2l_2$) (reference number 15) inclined at an interplanar angle of inclination $\alpha$ to the crystal surface 14. The lattice spacing for the planes ($h_1k_1l_1$) is $d_1$. The lattice spacing for the planes ($h_2k_2l_2$) is $d_2$.

An x-ray beam 12 contains two specific wavelengths to be isolated. The two specific wavelengths can be generated from a multiple-target source 17, or multiple characteristic lines from a single source can be used. First wavelength $W_1$ is diffracted by the set of lattice planes ($h_1k_1l_1$) parallel to the top crystal surface 14. Second wavelength $W_2$ is diffracted by the set of planes ($h_2k_2l_2$) inclined at the interplanar angle of inclination $\alpha$ to the top crystal surface 14. The angle of incidence between the wavelengths $W_1$, $W_2$ and the top surface 14 of the crystal 14 is $\theta_1$. The angle of incidence between wavelengths $W_1$, $W_2$ and the top lattice plane 16 that is inclined at the interplanar angle of inclination $\alpha$ is $\theta_2$. It is noted that the angles of incidence are controlled to be in conformity with Bragg's law to result in diffraction angles in an acceptable range. Specific angles of incidence depend on the specific materials and radiation wavelengths used.

Referring to FIG. 1, for this embodiment to work in accordance with the invention, the interplanar angle of inclination $\alpha$ is approximately equal to one-half the difference in diffraction angles. This requirement places a constraint on possible choices for the crystal 10. More specifically, to carry out the principles of the invention, a crystal 10 is selected that has the proper combination of lattice spacings ($d_1$ and $d_2$) and interplanar angle of inclination $\alpha$ for the diffraction of the two specific wavelengths $W_1$ and $W_2$.

It is understood that x-ray detectors 24 and 26 can be employed to detect the diffracted wavelengths $W_1$ and $W_2$, respectively.

To find a suitable combination of crystal and wavelengths, two approaches can be taken.

In the first approach, two wavelengths can be selected, and a search for a matching crystal can be made. This involves considering a particular crystal system, selecting two sets of lattice planes, and calculating a lattice parameter to satisfy the above diffraction conditions. A search is then made for an element, compound, or solid solution having this lattice parameter.

As an example of the first approach, consideration is given to a monochromator designed to simultaneously diffract copper K alpha and chromium K alpha radiation. Such a combination is valuable for diffraction experiments. If a face centered cubic structure is chosen for the crystal, then one possible combination of diffracting planes is (111)/(220), for which the interplanar angle of inclination $\alpha$ is 35.3 degrees.

More specifically, $$\alpha=\theta_2-\theta_1=35.3 \text{ degrees,} \quad (1)$$

where $\theta_1$ and $\theta_2$ ideally correspond to the Bragg relations:

$$\theta_1=\sin^{-1}(W_1/2d_1) \quad (2)$$

$$\theta_2=\sin^{-1}(W_2/2d_2) \quad (3)$$

Now, if the (111) planes are selected to diffract the copper K alpha radiation, and the (220) planes to diffract the chromium K alpha radiation, the appropriate wavelengths are:

$W_1=1.542$ Angstroms $W_2=2.292$ Angstroms

Furthermore, the lattice spacings for the face centered cubic system are:

$d_{111}=0.577a_o$ $d_{220}=0.353a_o$, where $a_o$ is the crystal lattice parameter.

Substituting these wavelengths and lattice spacings into equations (2) and (3) now gives:

$$\theta_1=\sin^{-1}(1.542/2(0.577a_o))=\sin^{-1}(1.34/a_o) \quad (4)$$

$$\theta_2=\sin^{-1}(2.292/2(0.353a_o))=\sin^{-1}(3.24/a_o) \quad (5)$$

Now, using equation (1), $$\alpha=35.3=\theta_2-\theta_1=\sin^{-1}(3.24/a_o)-\sin^{-1}(1.34/a_o) \quad (6)$$

A trial and error solution of equation (6) gives $a_o=3.950$ Angstroms.

A literature search indicated that a solid solution comprised of 85% platinum/15% gold has the lattice parameter of 3.950 Angstroms. More specifically, for a crystal 10 of a solid solution of 85% platinum/15% gold, with lattice planes of $(h_1k_1l_1)/(h_2k_2l_2)$ corresponding to (111)/(220), the (111) planes diffract the copper K alpha radiation of 1.542 Angstroms, and the (220) planes diffract the chromium K alpha radiation of 2.292 Angstroms.

Many other combinations of planes and crystal systems can also be considered. For other crystal systems, particularly those of lower symmetry, the number of candidate crystals will number in the thousands. In this case, a computer search is a practical way of finding a suitable crystal for a specific application.

In a second approach for finding a suitable combination of crystal and wavelengths, any convenient monochromator crystal can be used, and for each possible combination of $(h_1k_1l_1)/(h_2k_2l_2)$, two matching wavelengths are considered. For each combination of lattice planes, one wavelength $W_1$ is selected (preferably having a strong characteristic x-ray line), and a matching wavelength $W_2$ is then calculated. The process is repeated until a plane combination is found for which both $W_1$ and $W_2$ correspond to characteristic x-ray lines.

For example, if a sodium chloride crystal is used, and molybdenum K alpha radiation is selected for $W_1$, a number of potential matching wavelengths $W_2$ are presented in Table I hereinbelow for various combinations of lattice planes. The required matching wavelength is found in the far right column of Table I. It is noted that most of the potential wavelengths in Table I are not suitable for diffraction. Most of them either do not correspond to a characteristic x-ray emission line, or they are too soft for diffraction purposes. However, one combination of lattice planes appears to be suitable. The (311)/(220) pair gives a $W_2$ of 2.75 Angstroms, which is almost identical to the titanium K alpha radiation wavelength line of 2.748 Angstroms. Therefore, a sodium chloride crystal cut in the (311) orientation will be able to simultaneously diffract molybdenum K alpha radiation and titanium K alpha radiation.

TABLE I

Selection of matching wavelength for dual wavelength monochromator; NaCl crystal used; $W_1$ = 0.71 Angstroms.

| $(h_1k_1l_1)/(h_2k_2l_2)$ | $\alpha$ | $2\Theta_2$ | $W_2$ |
|---|---|---|---|
| (220)/(111) | 35.3 | 91.11 | 4.65 |
| (311)/(111) | 29.5 | 83.11 | 4.32 |
| (311)/(111) | 58.5 | 141.1 | 6.14 |
| (400)/(111) | 54.7 | 138.6 | 6.09 |
| (220)/(200) | 45.0 | 110.5 | 4.63 |
| (311)/(200) | 25.2 | 74.51 | 3.41 |
| (222)/(200) | 54.7 | 134.6 | 5.20 |
| (311)/(220) | 31.5 | 87.13 | 2.75 |
| (311)/(220) | 64.8 | 153.7 | 3.88 |
| (222)/(220) | 35.3 | 95.8 | 2.96 |
| (400)/(220) | 45.0 | 119.2 | 3.44 |
| (222)/(311) | 29.5 | 84.2 | 2.28 |
| (222)/(311) | 58.5 | 142.2 | 3.22 |
| (400)/(311) | 25.2 | 79.56 | 2.18 |

Figure 2:
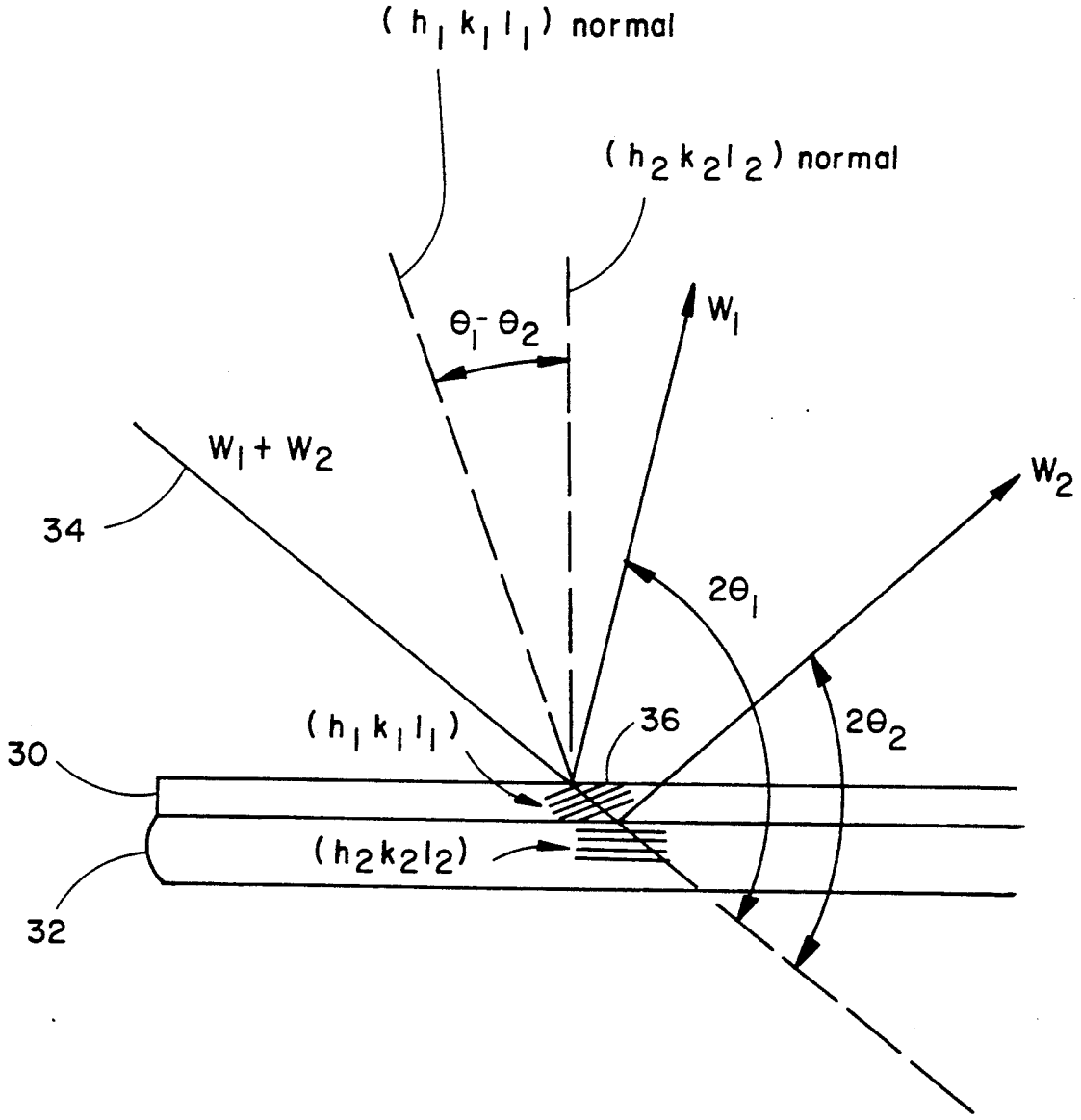
FIG. 2 is a schematic diagram showing another embodiment of the invention in which two wavelengths are separated by a stack of two different crystals having flat planar lattice planes.

Turning to FIG. 2, another embodiment of the crystalline monochromator is comprised of two crystals, top crystal 30 and bottom crystal 32, that are in a stacked (or layered) arrangement. An x-ray beam 34 contains wavelengths $W_1$ and $W_2$. Radiation of wavelength $W_1$ is diffracted by the crystal planes $(h_1k_1l_1)$ parallel to the top surface 36 of the top crystal 30. On the other hand, radiation of wavelength $W_2$ is diffracted by another set of planes $(h_2k_2l_2)$ of the bottom crystal 32. Referring to FIG. 2, it is seen that the top crystal must be cut so that the interplanar angle of inclination $\alpha$ is equal to $\theta_1-\theta_2$. The wavelengths and crystal material and thickness must be selected so that radiation of wavelength $W_1$ is only weakly absorbed by the top crystal 30. This is most easily accomplished by using two widely separated wavelengths in combination with a very light element (such as beryllium) for the top crystal 30.

In FIG. 2, a crystalline monochromator of the invention is shown for $W_1$ which corresponds to molybdenum K alpha radiation and for $W_2$ which corresponds to chromium K alpha radiation. More specifically, the top crystal 30 is made from beryllium, and the crystal is oriented so that the (0002) planes lie at an angle of 32.5 degrees to the crystal surface. The bottom crystal 32 is made from sodium chloride cut in the (200) orientation. The chromium K alpha line is diffracted from the beryllium at a Bragg angle of 79.5 degrees, and the molybdenum K alpha line is diffracted from the sodium chloride at an angle of 15.5 degrees. Simple attenuation calculations indicate that the required thickness of the beryllium crystal 30 is approximately 0.040 cm (for an infinitely thick beryllium crystal, 95% of the diffracted beam would originate from material at or above this depth). Similar calculations show that the molybdenum K alpha beam is attenuated only about 29% after passing through the beryllium layer, diffracting from the bottom crystal 32, and again traveling through the top crystal 30.

Beryllium is an appropriate material for the top crystal 30, as long as the two radiations $W_1,W_2$ differ sufficiently in wavelength. If it is necessary for the two wavelengths $W_1,W_2$ to be close together, then the material for the top crystal should be chosen so that its absorption edge lies between $W_1$ and $W_2$. For example, if the two K alpha x-ray lines are those of copper and nickel, then cobalt is used for the top crystal. That is, the cobalt K alpha edge is at 1.608 Angstroms; and the copper and nickel K alpha lines are at 1.542 Angstroms and 1.660 Angstroms, respectively. Nickel radiation will therefore penetrate the cobalt layer with relative ease, while copper radiation will be more severely attenuated by it.

Figure 3:
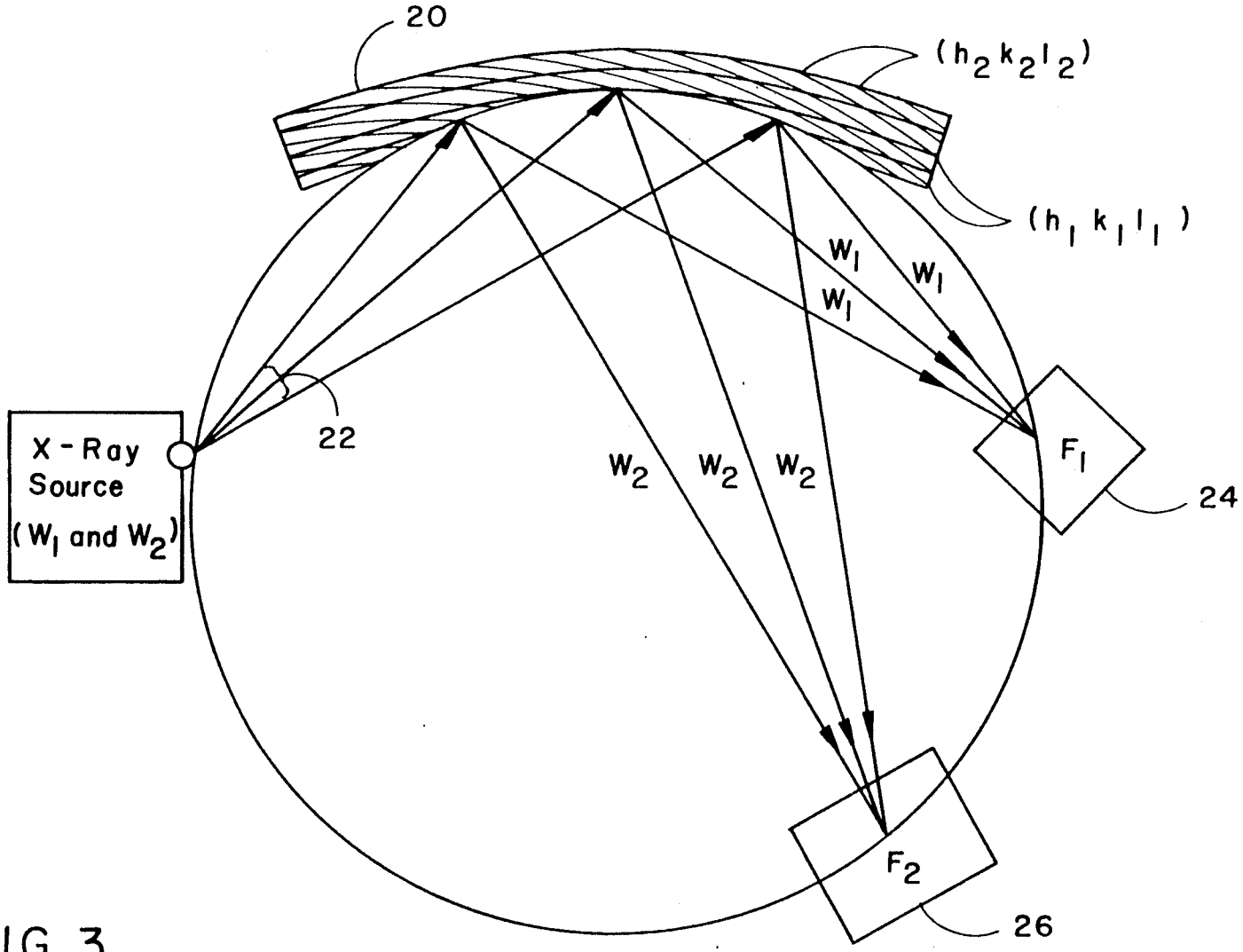
FIG. 3 is a schematic diagram showing another embodiment of the invention in which two wavelengths are separated by a bent crystal.

Turning to FIG. 3, a crystalline monochromator is in the form of a curved crystal 20. The curved nature of the curved crystal 20 permits optical focussing to be employed. A normally divergent x-ray beam 22 includes wavelengths $W_1$ and $W_2$. X-rays of $W_1$ are diffracted by planes $(h_1k_1l_1)$ and are brought to a focus at point $F_1$. Similarly, x-rays of $W_2$ are diffracted by planes $(h_2k_2l_2)$ not parallel to the $(h_1k_1l_1)$ planes and are brought to a focus at point $F_2$. A first detector 24 is placed to receive x-rays of $W_1$ at $F_1$. A second detector 26 is placed to receive x-rays of $W_2$ at $F_2$. Signals corresponding to detected rays of $W_1$ and signals corresponding to detected rays of $W_2$ can be sent to an appropriately adjusted pulse height analyzer (not shown).

The curved crystal 20 has an additional advantage in that it can be "tuned" by elastically bending it. When a crystal plane is elastically bent, the $d_1$ spacing of planes parallel to the crystal surface remains approximately constant. However, the $d_2$ spacing of the planes inclined to the surface will increase or decrease, depending on the direction (or (+) or (−) sign) of the applied stress. Bending the curved crystal 20 into a concave shape will cause the interplanar spacing of the $(h_2k_2l_2)$ planes to decrease slightly. If the lattice parameter of the crystal is slightly larger than needed, then this elastic strain will allow a slight correction.

It is noted that bent crystals are well known in the art of x-ray diffraction of single wavelengths. They are made using standard methods well known in the art. Bending is commonly done with monochromator crystals; and there are many ways to manufacture a bend crystal. Typically, a bent crystal is either fabricated or molded. More specifically, the crystal can be mechanically bent at elevated temperatures, or the crystal can be formed by a deposition process (a molding process) on a form.

However, a number of benefits are obtained by employing the principles of the invention. With the invention, plural, separated monochromatic wavelengths are provided from a beam containing a combination of plural wavelengths. More specifically, with the invention, plural, separated monochromatic x-ray wavelengths are provided from an x-ray beam containing a combination of plural x-ray wavelengths. The invention provides a multiple wavelength x-ray dispersive device that is simple in construction and does not require a large number of repeating layer units.

The foregoing description of the invention has been presented for purposes of illustration and description. It is not intended to be exhaustive or to limit the invention to the precise form disclosed. Obvious modifications or variations are possible in light of the above teachings. The embodiments were chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A crystal monochromator apparatus for separating an input ray of radiation, which contains a combination of first and second wavelengths, into spatially separate first and second output rays of radiation which contain the first and second wavelength, respectively, said apparatus comprising:

a source of input rays of radiation containing a combination of first and second wavelengths, and means, receiving input radiation from said source, for diffracting the input radiation into separate first and second output radiation rays, said first and second output rays containing said first and second wavelengths, respectively, said input radiation diffracting means being comprised of a single crystal which includes a top surface, a first set of parallel crystal planes, each of said planes being spaced a predetermined first distance from one another and parallel to the top surface, and a second set of parallel crystal planes inclined at an angle with respect to said top surface, each of said planes of said second set being spaced a predetermined second distance from one another.

2. The apparatus described in claim 1 wherein the combination of first and second wavelengths is superimposed on a background of white radiation.

3. The apparatus described in claim 1 wherein the first and second wavelengths in the input ray are x-rays.

4. The apparatus described in claim 1 wherein the first and second wavelengths in the input ray are gamma rays.

5. The apparatus described in claim 1 wherein said single crystal is bent for focussing said separate first and second output radiation rays into separate focal points.

6. The apparatus described in claim 1 wherein said single crystal is comprised of a solid solution of 85% platinum/15% gold by weight, said crystal having (111) planes and (220) planes.

7. The apparatus described in claim 6 wherein said apparatus is used for simultaneous diffraction of copper K alpha and chromium K alpha radiation.

8. The apparatus described in claim 7 wherein the copper K alpha radiation has a wavelength of approximately 1.542 Angstroms, and the chromium K alpha radiation has a wavelength of approximately 2.292 Angstroms.

9. The apparatus described in claim 1 wherein said single crystal is oriented to that the (111) planes are parallel to the top surface of the crystal.

10. The apparatus described in claim 1 wherein said single crystal is comprised of a sodium chloride crystal having (311) planes and (220) planes.

11. The apparatus described in claim 1 wherein said apparatus is used for simultaneous diffraction of molybdenum K alpha and titanium K alpha radiation.

12. The apparatus described in claim 11 wherein the molybdenum K alpha radiation has a wavelength of approximately 0.71 Angstroms, and the titanium K alpha radiation has a wavelength of approximately 2.748 Angstroms.

13. The apparatus described in claim 1 wherein said single crystal is oriented to that the (311) planes are parallel to the top surface of the crystal.

14. A crystal monochromator apparatus for providing plural separated monochromatic wavelengths from a source of input radiation which contains a plurality of combined wavelengths, said apparatus comprising:

a source of input rays of radiation containing a combination of first and second wavelengths, means, receiving input radiation from said source, for diffracting the input radiation into first and second output radiation rays, said first and second output rays containing said first and second wavelengths, respectively, said input radiation diffracting means being comprised of a crystalline diffractor which includes a top surface, a first set of parallel crystal planes spaced a predetermined first distance from one another and parallel to the top surface and a second set of parallel crystal planes inclined at an angle of inclination with respect to the top surface and spaced a predetermined second distance from one another, said crystalline diffractor comprising a single crystal that is bent for focussing said first and second output radiation rays into separate focal points, and first and second output radiation detectors, for detecting said first and second wavelengths of said first and second output rays, respectively.

15. The apparatus described in claim 14 wherein said single crystal is bent along a circumference of a circle for focussing said separate first and second output radiation rays onto said respective first and second output radiation detectors located along the circumference of said circle.

16. A crystal monochromator apparatus for providing plural separated monochromatic x-ray wavelengths from a source of input radiation which contains a plurality of combined x-ray wavelengths, said apparatus comprising:

a source of input rays of x-ray radiation containing a combination of first and second x-ray wavelenths, means, receiving input radiation from said source, for diffracting the input radiation into separate first and second output radiation rays, said first and second output rays containing said first and second x-ray wavelengths respectively, said input radiation diffracting means being comprised of a crystalline diffractor which includes a top surface, a first set of parallel crystal planes spaced a predetermined first distance from one another and parallel to the top surface, and a second set of parallel crystal planes inclined at an angle of inclination with respect to the top surface and spaced a predetermined second distance from one another, and first and second output x-ray radiation detectors, for detecting said first and second x-ray wavelengths of said first and second output rays, respectively, wherein said crystalline diffractor is comprised of a single crystal that is bent along a circumference of a circle for focussing said separate first and second output radiation rays onto said respective first and second output x-ray radiation detectors located along the circumference of said circle.

17. A method of separating an input ray of radiation, which contains a combination of first and second wavelengths, into separate first and second output rays of radiation which contain the first and second wavelengths, respectively, said method comprising the steps of:

establishing a circular array of a radiation source and a bendable crystalline diffractor which includes a top surface, a first set of parallel crystal planes spaced a predetermined first distance from one another and parallel to the top surface, and a second set of parallel crystal planes inclined at an angle of inclination with respect to the top surface and spaced a predetermined second distance from one another, wherein the top surface has a radius of curvature substantially equal to the radius of the circular array, directing input radiation from the source into the bendable crystalline diffractor such that the input radiation is separated into first and second output radiation rays containing the first and second wavelengths, respectively, bending the bendable crystalline diffractor such that the first and second output radiation rays are focussed onto first and second focal points, respectively, arrayed on the circular array.

* * * * *